US006803711B2

(12) United States Patent
Im et al.

(10) Patent No.: US 6,803,711 B2
(45) Date of Patent: Oct. 12, 2004

(54) MASK FOR COLOR CATHODE RAY TUBE HAVING BENEFICIAL SLOT AND BRIDGE CONFIGURATIONS, MANUFACTURING METHOD THEREOF, AND EXPOSURE MASK FOR MANUFACTURING THE MASK

(75) Inventors: Young-bin Im, Suwon (KR); Deok-hyeon Choe, Suwon (KR)

(73) Assignee: Samsung SDI Co., Ltd., Gyeonggi-do (KR)

( * ) Notice: Subject to any disclaimer, the term of this patent is extended or adjusted under 35 U.S.C. 154(b) by 112 days.

(21) Appl. No.: 09/934,689

(22) Filed: Aug. 23, 2001

(65) Prior Publication Data

US 2002/0027405 A1 Mar. 7, 2002

(30) Foreign Application Priority Data

Sep. 1, 2000 (KR) ..... 2000-51523

(51) Int. Cl.[7] ..... H01J 29/80

(52) U.S. Cl. ..... 313/402; 313/403; 313/405; 313/406; 313/407; 430/5; 430/23; 430/25; 156/644; 445/36; 445/37; 445/47

(58) Field of Search ..... 430/5, 23, 25–27; 445/36, 37, 47; 156/644; 313/402–407

(56) References Cited

U.S. PATENT DOCUMENTS 3,883,770 A * 5/1975 Yamada et al. ..... 313/403
3,916,243 A * 10/1975 Brown ..... 313/403
3,973,965 A * 8/1976 Suzuki et al. ..... 430/5
4,094,678 A 6/1978 Palac ..... 96/36.1
4,210,843 A 7/1980 Avadani ..... 313/403
4,227,115 A * 10/1980 Elshof et al. ..... 313/403
5,200,025 A * 4/1993 Toei et al. ..... 216/12
5,309,059 A * 5/1994 Kume et al. ..... 313/402
5,336,587 A * 8/1994 Tanaka et al. ..... 430/322
5,411,822 A * 5/1995 Ohtake et al. ..... 430/5
5,523,647 A * 6/1996 Kawamura et al. ..... 313/407
5,856,725 A * 1/1999 Ueda ..... 313/402
6,072,270 A * 6/2000 Hu et al. ..... 313/402
6,107,729 A * 8/2000 Banno ..... 313/403
2001/0007406 A1 * 7/2001 Kim ..... 313/402
2001/0050524 A1 * 12/2001 Choe et al. ..... 313/402

* cited by examiner

*Primary Examiner*—Nimeshkumar D. Patel
*Assistant Examiner*—Sikha Roy
(74) *Attorney, Agent, or Firm*—Robert E. Bushnell, Esq.

(57) ABSTRACT

A mask for a color cathode ray tube (CRT) and a manufacturing method thereof are provided. This mask includes a plurality of strips isolated from each other at predetermined intervals in parallel, and a plurality of bridges for forming slots through which electron beams pass by connecting adjacent strips to each other. In this mask, each of the bridges between adjacent strips has a first curved portion formed on the side from which electron beams come out, and a second curved portion formed on the side upon which electron beams are incident. The first curved portion has a first width in the direction perpendicular to the length direction of the strips, and extends in the length direction of the strips. The second curved portion has a second width that is smaller than the first width in the length direction of the adjacent strips.

14 Claims, 13 Drawing Sheets

MASK FOR COLOR CATHODE RAY TUBE HAVING BENEFICIAL SLOT AND BRIDGE CONFIGURATIONS, MANUFACTURING METHOD THEREOF, AND EXPOSURE MASK FOR MANUFACTURING THE MASK

CLAIM OF PRIORITY

This application makes reference to, incorporates the same herein, and claims all benefits accruing under 35 U.S.C. §119 from my application SHADOW-MASK FOR COLOR PICTURE TUBE AND METHOD OF MANUFACTURING THE SAME AND EXPOSURE ASK FOR MAKING THE SHADOW-MASK filed with the Korean Industrial Property Office on Sep. 1, 2000 and there duly assigned Ser. No. 51523/2000.

BACKGROUND OF THE INVENTION

1. Technical Field

The present invention relates to color cathode ray tubes, and more particularly, to a mask which is installed adjacent to a fluorescent film within the panel of a cathode ray tube and performs a color selection function, a manufacturing method thereof, and an exposure mask for manufacturing the shadow mask.

2. Related Art

In color cathode ray tubes (CRTs), which are used in the monitors of typical computers, televisions and the like, three electron beams emitted from an electron gun pass through the electron beam pass holes of a mask having a color selection function and land on red, green and blue fluorescent materials of a fluorescent film formed on the screen surface of a panel, thereby exciting the fluorescent materials to thus form an image.

In the above-described cathode ray tubes for forming pictures, masks having a color selection function include dot masks adopted in the monitor of computers and slot masks (or slit masks) used in televisions or the like.

A slot mask is designed to have the same curvature as a screen surface in consideration of landing of deflected electron beams. A mask as described above is obtained by forming a plurality of electron beam pass holes by etching a 0.1 to 0.25 millimeter (mm) thin plate, and molding the thin plate at a predetermined curvature. If the mask does not have a curvature equal to or greater than a predetermined level, it is permanently plastic-deformed in many cases during the manufacture of a cathode ray tube due to a decrease in the structural strength. As a result, there are many cases in which the mask cannot perform its unique color selection function. Also, as the incidence angle of electron beams passing through the slot increases, the amount of beams passing through the slot decreases.

Methods of manufacturing masks are disclosed in U.S. Pat. No. 4,094,678 to Palac, entitled METHOD OF MAKING CURVED COLOR CATHODE RAY TUBE SHADOW MASKS HAVING INTERREGISTRABLE ELECTRON BEAM-PASSING APERTURE PATTERNS, issued on Jun. 13, 1978 and in U.S. Pat. No. 4,210,843 to Avadani, entitled COLOR CRT SHADOW MASK AND METHOD OF MAKING SAME, issued on Jul. 1, 1980. The disclosed method of manufacturing masks adopts photolithography.

While these recent efforts provide advantages, we note that they fail to adequately provide an efficient and convenient manufacturing method for manufacturing an improved mask for a color cathode ray tube, and fail to adequately provide an efficient and convenient exposure mask for manufacturing the improved mask.

SUMMARY OF THE INVENTION

To solve the above problems and others, an objective of the present invention is to provide a method of manufacturing a mask for a color cathode ray tube, by which a restriction on the formation of slots and bridges by the thickness of a thin film can be reduced.

Another objective of the present invention is to provide an exposure mask used to perform a method of manufacturing masks.

To achieve these and other objects in accordance with the principles of the present invention, as embodied and broadly described, the present invention provides a mask for a color cathode ray tube, the mask including: a plurality of strips isolated from each other at predetermined intervals in parallel; and a plurality of bridges which connect adjacent strips to each other, are indented a predetermined depth from their upper surfaces, and thus form slots through which electron beams pass.

To achieve these and other objects in accordance with the principles of the present invention, as embodied and broadly described, the present invention provides a mask for a color cathode ray tube, the mask including: a plurality of strips isolated from each other at predetermined intervals in parallel; and a plurality of bridges for forming slots through which electron beams pass by connecting adjacent strips to each other. In this mask, each of the bridges between adjacent strips has a first curved portion formed on the side from which electron beams come out, and a second curved portion formed on the side upon which electron beams are incident. The first curved portion has a first width in the direction perpendicular to the length direction of the strips, and extends in the length direction of the strips. The second curved portion has a second width that is smaller than the first width in the length direction of the adjacent strips.

To achieve these and other objects in accordance with the principles of the present invention, as embodied and broadly described, the present invention provides a method of manufacturing a mask for a color cathode ray tube, the method including: coating the upper and lower surfaces of a thin plate with photosensitive films; arranging an upper exposure mask on the upper surface of the thin plate, the upper exposure mask having an exposure pattern in which first light transmission strips are formed in parallel to each other; arranging a lower exposure mask on the lower surface of the thin plate, the lower exposure mask having an exposure pattern in which second light transmission strips are formed in parallel to each other, and light blocking bridges are formed; exposing the photosensitive films to light in a state where the upper and lower exposure masks are arranged on the thin film; separating the upper and lower exposure masks from the thin plate, and developing the photosensitive films on the thin plate; etching the thin plate, the photosensitive films on which have been developed; and molding a mask to have a predetermined curvature.

To achieve these and other objects in accordance with the principles of the present invention, as embodied and broadly described, the present invention provides a mask for a color cathode ray tube, the mask comprising: a plurality of strips being parallel to each other, being isolated from each other, and being located at predetermined intervals; and a plurality of bridges connecting adjacent ones of said strips to each other and forming slots penetrated by electron beams, said bridges being indented to a predetermined depth from an upper surface of said bridges so that a thickness at a central portion of said bridges is relatively thinner than a thickness at an outer portion of said bridges.

To achieve these and other objects in accordance with the principles of the present invention, as embodied and broadly described, the present invention provides a method of manufacturing a mask for a color cathode ray tube, the method comprising: coating upper and lower surfaces of a thin plate with photosensitive films; arranging an upper exposure mask on said upper surface of said thin plate, said upper exposure mask having an exposure pattern with upper light transmission strips being formed in parallel to each other; arranging a lower exposure mask on said lower surface of said thin plate, said lower exposure mask having an exposure pattern with lower light transmission strips being formed in parallel to each other, and having lower light blocking bridges separating said lower light transmission strips; exposing said photosensitive films to light in a state where said upper and lower exposure masks are arranged on said thin plate; separating said upper and lower exposure masks from said thin plate, and developing said photosensitive films on said thin plate; when said developing of said photosensitive films is performed, etching said thin plate; and molding a mask to have a predetermined curvature.

To achieve these and other objects in accordance with the principles of the present invention, as embodied and broadly described, the present invention provides an exposure mask assembly, comprising: an upper exposure mask being closely attached to an upper surface of a thin plate, said upper surface being coated with photosensitive films, said upper exposure mask having an exposure pattern with upper light transmission strips being formed in parallel to each other; and a lower exposure mask being closely attached to a lower surface of said thin plate, said lower surface being coated with photosensitive films, said lower exposure mask having an exposure pattern with lower light transmission strips being formed in parallel to each other, and having lower light blocking bridges separating said lower light transmission strips, said lower light blocking bridges blocking light; said photosensitive films on said upper and lower surfaces being exposed to light penetrating said upper and lower exposure masks through said upper and lower light transmission strips, respectively.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DESCRIPTION OF THE PREFERRED EMBODIMENTS

Figure 1:
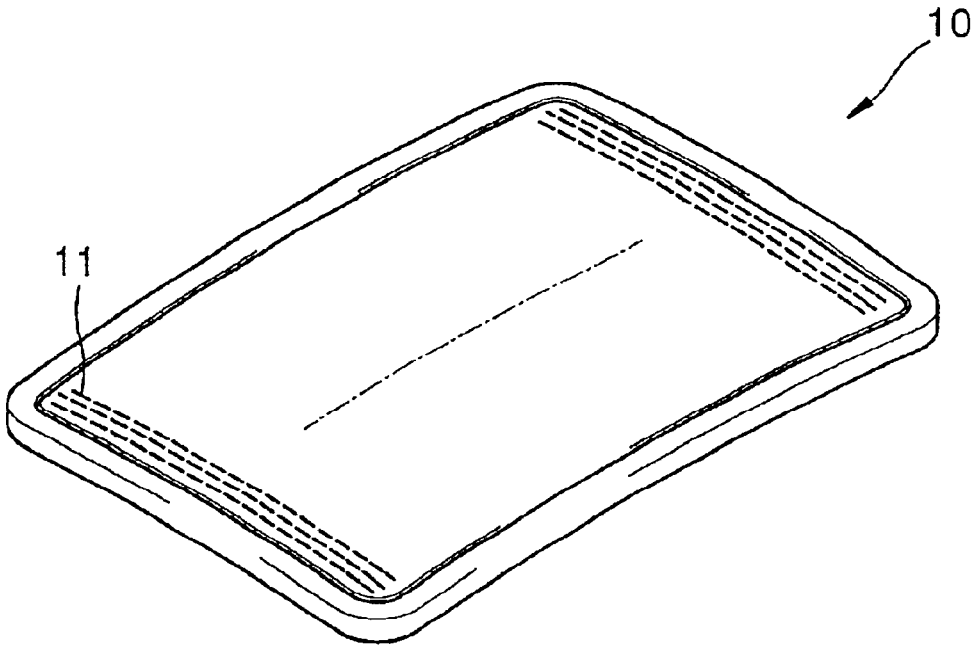
FIG. 1 is a perspective view of a mask in a cathode ray tube.

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that, in the development of any actual embodiment, numerous implementation-specific decisions must he made to achieve the developers specific goals, such as compliance with system-related and business-related constraints, which will vary from one implementation to another. Moreover, it will he appreciated that such a development effort might be complex and time-consuming, but would nevertheless be a routine undertaking for those of ordinary skill having the benefit of this disclosure.

A method of manufacturing a mask is as follows. Both surfaces of a thin plate are coated with photosensitive films. Upper and lower exposure masks, on each of which a predetermined exposing pattern is formed, are closely attached to both surfaces of the thin plate each coated with the photosensitive film. The resultant thin plate is exposed to light. Here, the upper exposure mask, which is opaque, has upper light transmission strips formed in parallel and partitioned by upper light shield bridges, thereby having a pattern that is similar to the slot pattern of a mask. The lower exposure mask has lower light transmission strips having a width that is smaller than the width of the upper light transmission strips. The lower light transmission strips form patterns by being partitioned by lower light shield bridges that are wider than the upper light blocking bridges. After the thin plate having the photosensitive films formed on both surfaces has been completely exposed using the above-described exposure masks, it is developed and then etched using high-pressure flushing water. Although not shown in the drawings, the thin plate is formed to have a valid area having a predetermined curvature and a skirt extending from the edge of the valid area, thereby manufacturing a mask.

In a mask formed by a method as described above, a slot is formed in strips and has an upper width that is larger than a lower width. As bi-directional etching is performed from the upper and bottom surfaces of the mask, a boundary portion is formed at the boundary between a position of the length from the upper surface of the strips and a position of the length from the bottom surface thereof. Therefore, as the incidence angle of electron beams passing through the slot increases, the amount of beams passing through the slot decreases.

As shown in FIG. 1, a slot mask is designed to have the same curvature as a screen surface in consideration of landing of deflected electron beams. A mask 10 as described above is obtained by forming a plurality of electron beam pass holes 11 by etching a 0.1 to 0.25 millimeter thin plate, and molding the thin plate at a predetermined curvature. If the mask 10 does not have a curvature equal to or greater than a predetermined level, it is permanently plastic-deformed in many cases during the manufacture of a cathode ray tube due to a decrease in the structural strength. As a result, there are many cases that the mask 10 cannot perform its unique color selection function.

Methods of manufacturing a mask are disclosed in U.S. Pat. Nos. 4,094,678 and 4,210,843. The disclosed method of manufacturing masks adopts photolithography. A method of manufacturing a mask using a photolithographic process will now be described in detail, while referring to FIGS. 2A through 2C.

Figure 2A:
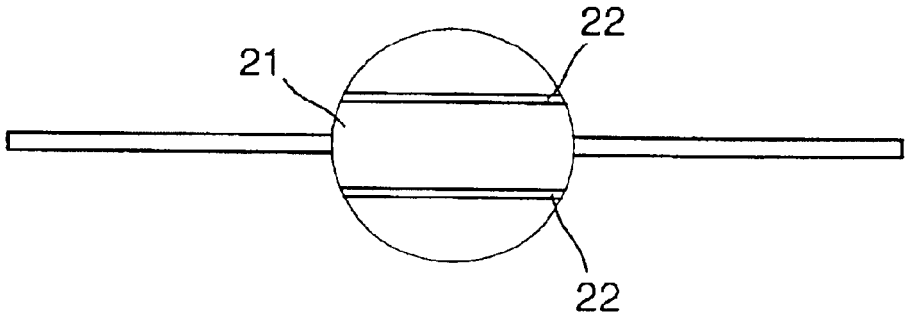
FIGS. 2A through 2C are views illustrating a method of manufacturing a mask.
Figure 2B:
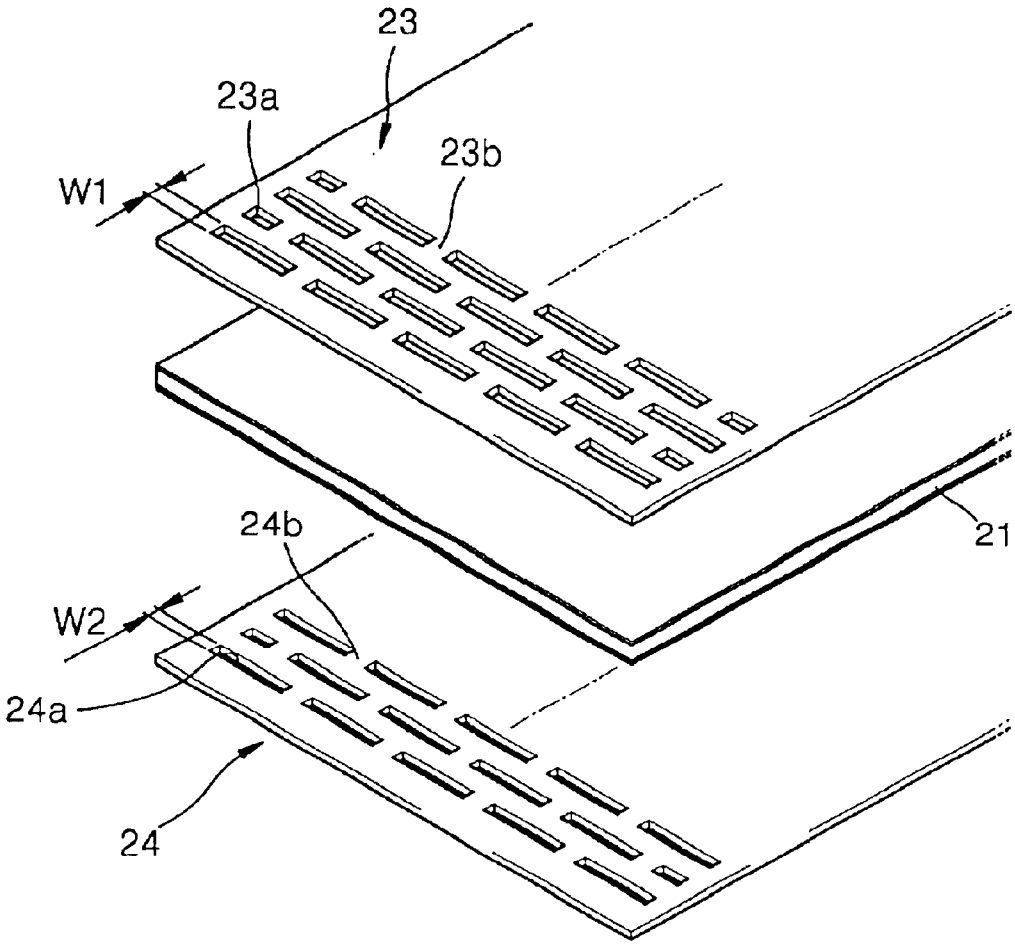
Figure 2C:
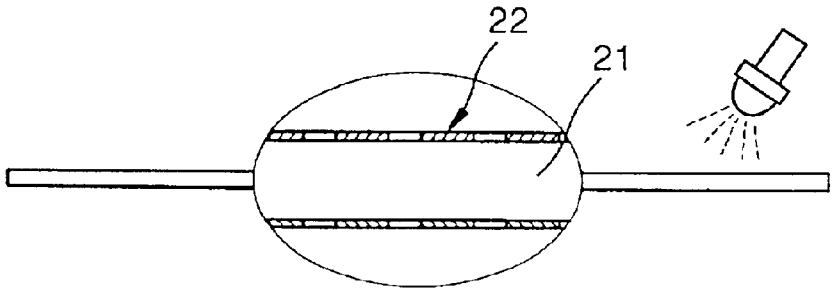

Referring to FIG. 2A, both surfaces of a thin plate 21 are coated with photosensitive films 22. Referring to FIG. 2B, upper and lower exposure masks 23 and 24, on each of which a predetermined exposing pattern is formed, are closely attached to both surfaces of the thin plate 21 each coated with the photosensitive film 22. The resultant thin plate 21 is exposed to light (not shown). Here, the upper exposure mask 23, which is opaque, has upper light transmission strips 23*a* formed in parallel and partitioned by upper light shield bridges 23*b*, thereby having a pattern that is similar to the slot pattern of a mask. The lower exposure mask 24 has lower light transmission strips 24*a* having a width W2 that is smaller than the width W1 of the upper light transmission strips 23*a*. The lower light transmission strips 24*a* form patterns by being partitioned by lower light shield bridges 24*b* that are wider than the upper light blocking bridges 23*b*. Referring to FIG. 2C, after the thin plate 21 having the photosensitive films 22 formed on both surfaces has been completely exposed using the above-described exposure masks, it is developed and then etched using high-pressure flushing water. Although not shown in the drawings, the thin plate is formed to have a valid area having a predetermined curvature and a skirt extending from the edge of the valid area, thereby manufacturing a mask.

Figure 3:
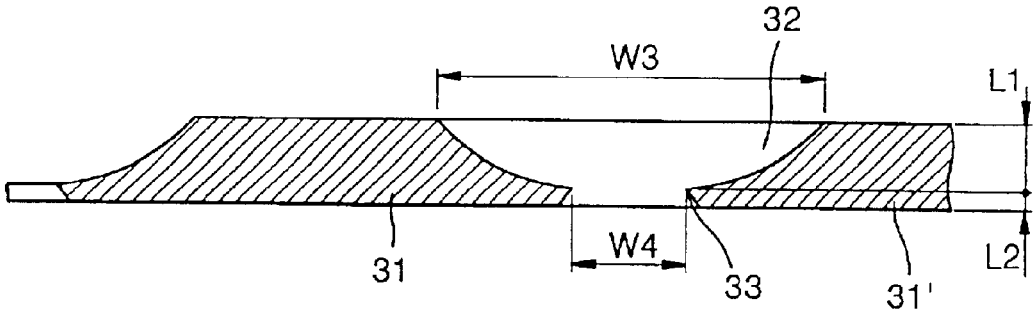
FIG. 3 is a cross-sectional view of the slot formed portion shown in FIG. 1.

In a mask formed by a method as described above, as shown in FIG. 3, a slot 32 formed in strips 31 and 31' has an upper width W3 that is larger than a lower width W4. As bi-directional etching is performed from the upper and bottom surfaces of the mask, a boundary portion 33 is formed at the boundary between a position of the length L1 from the upper surface of the strips and a position of the length L2 from the bottom surface thereof. The length L1 is greater than the length L2. Therefore, as the incidence angle of electron beams passing through the slot 32 increases, the amount of beams passing through the slot decreases.

Figure 4:
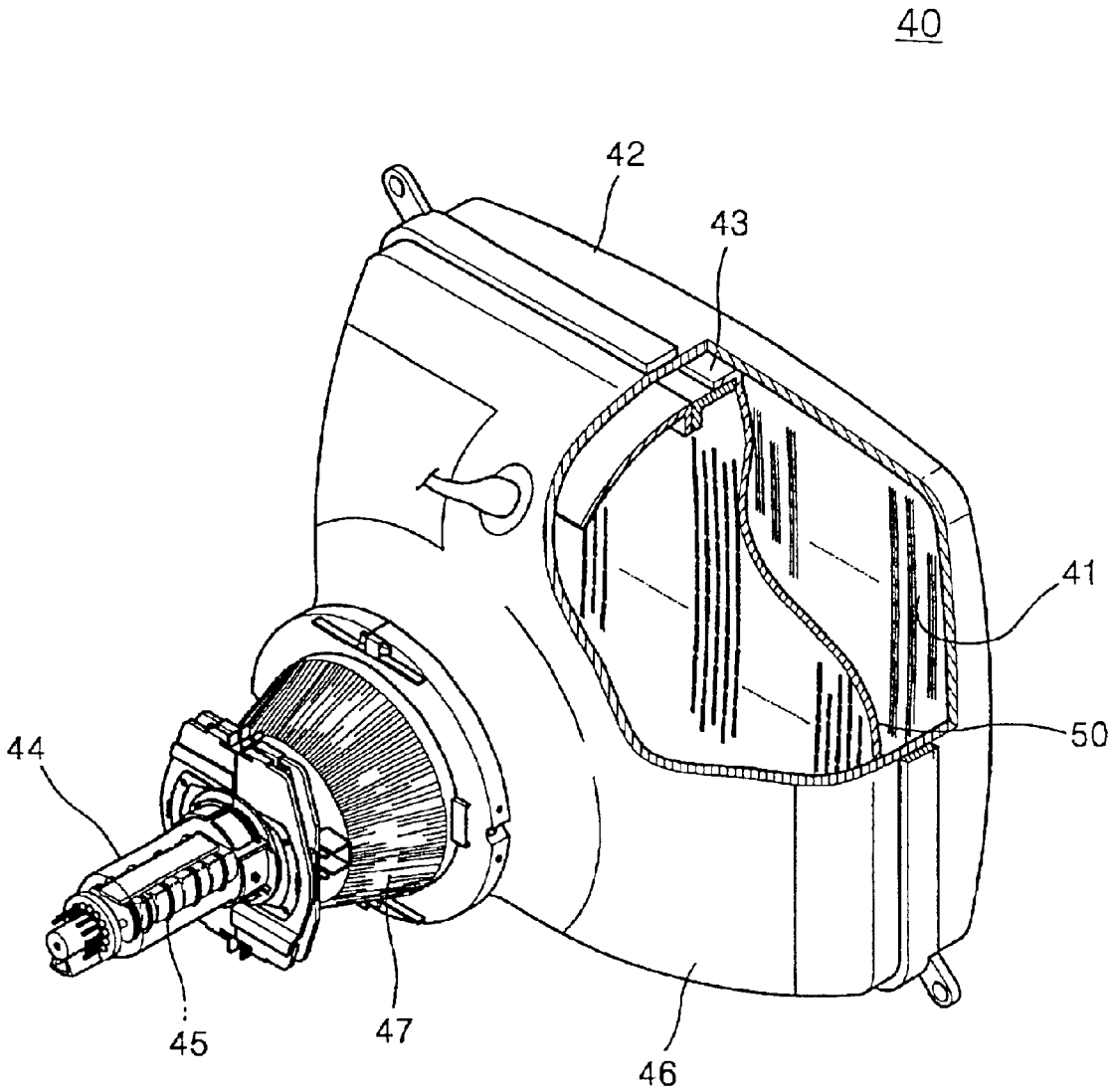
FIG. 4 is a partially-open perspective view of a cathode ray tube, in accordance with the principles of the present invention.

FIG. 4 shows a cathode ray tube in which a mask according to the present invention is installed. As shown in FIG. 4, a cathode ray tube 40 includes a panel 42 on the inner surface of which a fluorescent film 41 having a predetermined pattern is formed, a mask 50 installed on the inner surface of the panel 42 to allow three electron beams to accurately land on the fluorescent layer of the fluorescent film, and a frame 43 supported by the panel 42 for supporting the mask having a predetermined curvature.

The panel 42 is sealed by a funnel 46 having a neck portion 44 in which an electron gun 45 is installed, and a deflection yoke 47 for deflecting electron beams emitted from the electron gun 45 to land the electron beams accurately on the fluorescent layer is installed on the neck portion 44 and a corn portion of the funnel 46.

Figure 5:
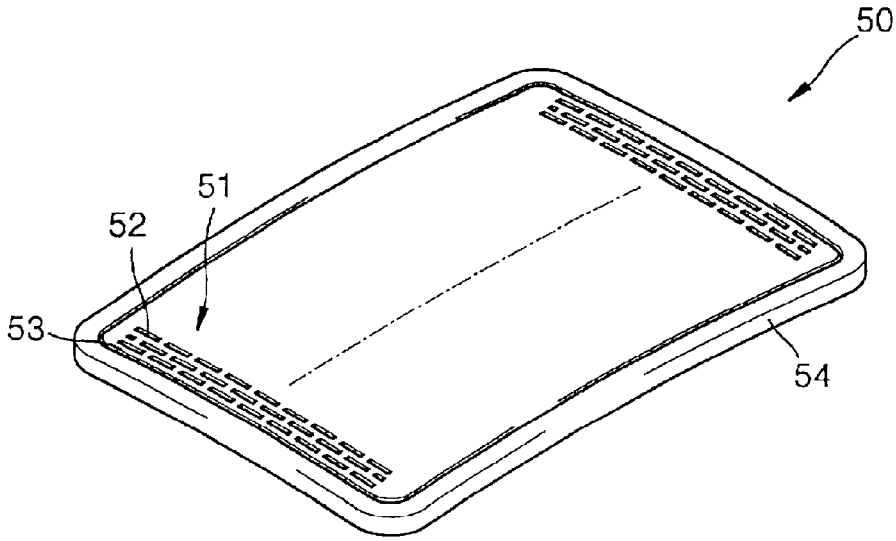
FIG. 5 is a perspective view of a mask, in accordance with the principles of the present invention, according to a first embodiment.
Figure 6:
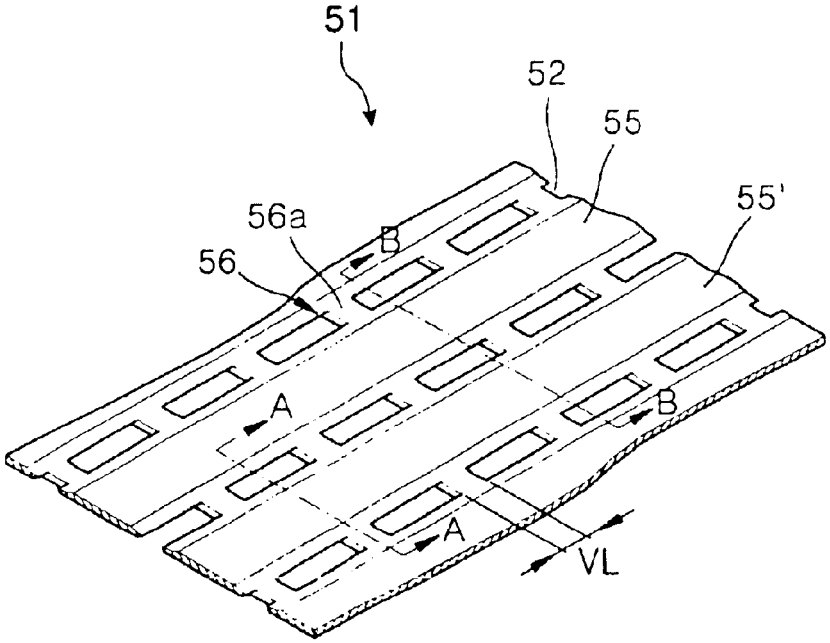
FIG. 6 is a magnified perspective view of the mask of FIG. 5.

The mask 50 for accurately landing three electron beams on a fluorescent film, in the cathode ray tube of FIG. 4, will be shown in FIGS. 5 and 6. As shown in FIG. 5, the mask 50, which is a thin plate, is made up of a slotted portion 51 on which a plurality of slots 52 are formed in strips at a predetermined curvature, a non-slotted portion 53 extending from the slotted portion 51, and a skirt 54 folded at right angles from the non-slotted portion 53. The slotted portion 51 can be referred to as holey portion 51, and the non-slotted portion 53 can be referred to as holeless portion 53.

Figure 7:
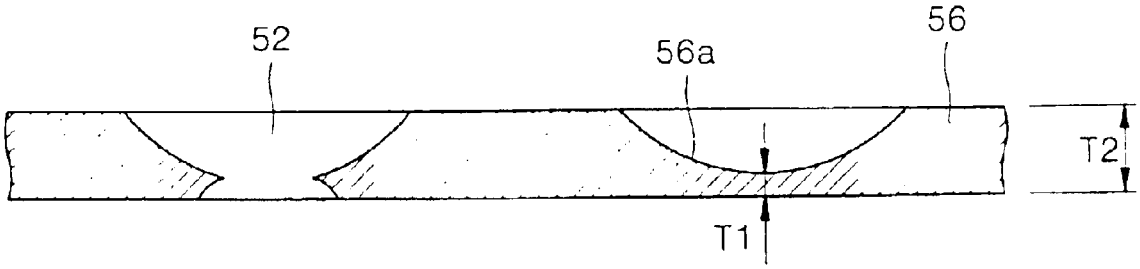
FIG. 7 is a cross-sectional view of FIG. 6 taken along line A—A.
Figure 20:
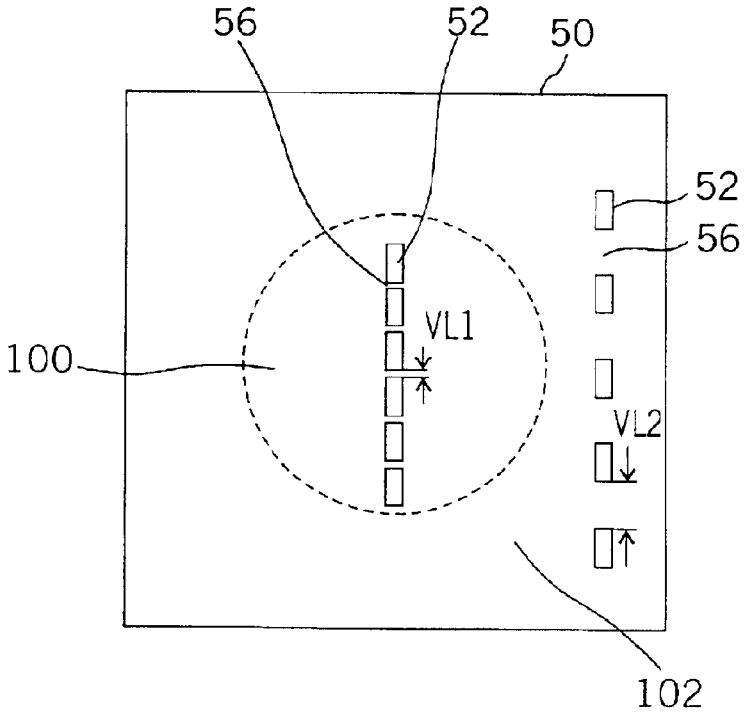
FIG. 20 shows a view of a shadow mask, in accordance with the principles of the present invention.

As shown in FIG. 6, a strip 55 (or 55') is formed between adjacent slots 52 in the direction of arrangement of the slots of the holey portion 51, and a plurality of bridges 56 for defining the slots 52 by connecting the strips 55 and 55' to each other are formed in the direction perpendicular to the direction of arrangement of the slots 52. As shown in FIG. 7, the upper surface of the bridge 56 has an indent 56*a* indented to a predetermined depth, so that the thickness T1 of the center of the bridge 56 can be thinner than the thickness T2 of the strip 55. Preferably, the thickness T1 of the center of the bridge depending on the depth of the indent 56*a* becomes thicker in the direction from the center of the mask to the periphery thereof in order to prevent a decrease in the structural strength of the mask. Also, preferably, in the case that the indent 56*a* is formed on the upper surface of the bridge, and the thickness T1 of the center of the bridge 56 is invariable, the vertical length VL of the bridge becomes longer in the direction from the center of the mask to the periphery thereof. In other words, the vertical length VL of a bridge at a central region of the mask is smaller than the vertical length VL of a bridge at a periphery region of the mask. The bridges are formed so that the lengths of the bridges gradually increase when one looks at the center of the mask and then looks across the mask over to the periphery of the mask. FIG. 20 shows that vertical length VL1 of a bridge 56 at central region 100 of mask 50 is shorter than vertical length VL2 of a bridge 56 at a periphery 102 of the mask 50.

When the mask 50 is oriented horizontally, it can be said to have an upper face and a lower face, which correspond to an upper side and a lower side, respectively. The upper face of mask 50 is depicted in FIG. 5. In FIG. 5, the lower face of mask 50 is hidden from view because of the position of the depicted mask 50. FIG. 7 shows a thickness T2 as measured from the upper face of mask 50 to the lower face of mask 50. FIG. 7 also shows a thickness T1 as measured from a bottom of an indentation 56*a* to the lower face of mask 50.

Figure 8:
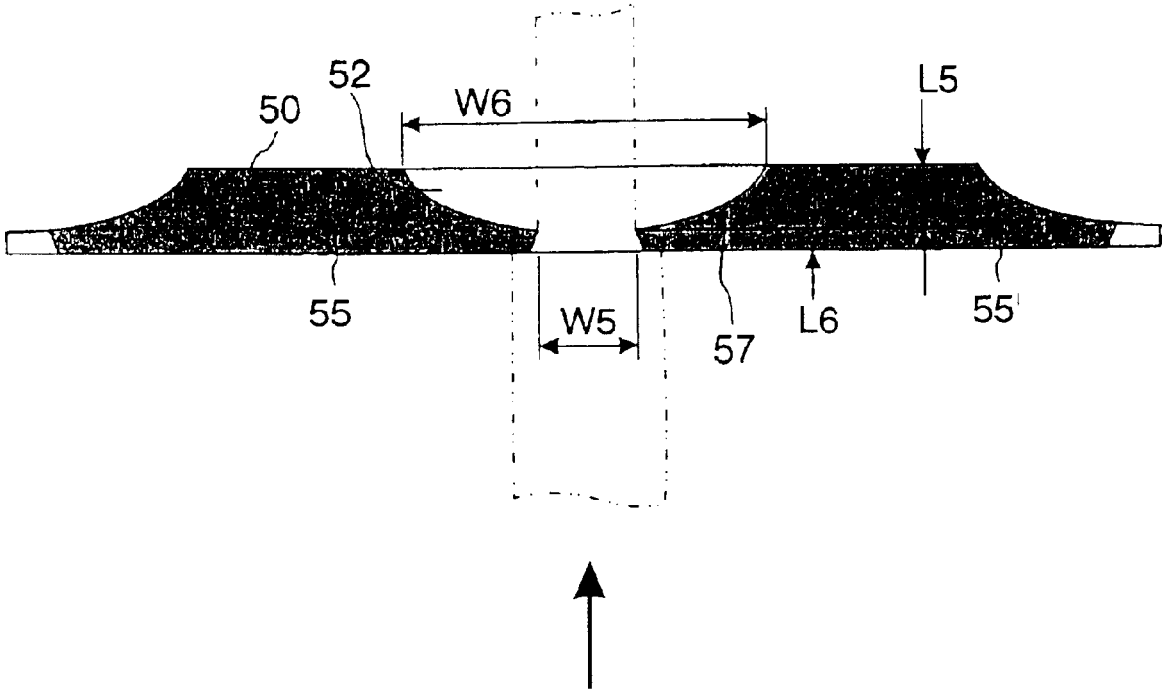
FIG. 8 is a cross-sectional view of FIG. 6 taken along line B—B.

In the mask constructed as described above, as shown in FIG. 8, on both sides of a slot defined by bridges 56, that is, both sides of a slot in the direction perpendicular to the length direction of the strips 55 and 55', the width W5 of the surface upon which electron beams emitted from an electron gun are incident is smaller than the width W6 of the surface from which the electron beams come out. Also, as shown in FIG. 8, the length L6 from the bottom surface of the strip 55 to an etching boundary 57 is shorter than the length L5 from the upper surface of the strip 55 to the etching boundary 57. FIG. 8 shows a slot 52 at a central region of the mask 50.

Figure 17:
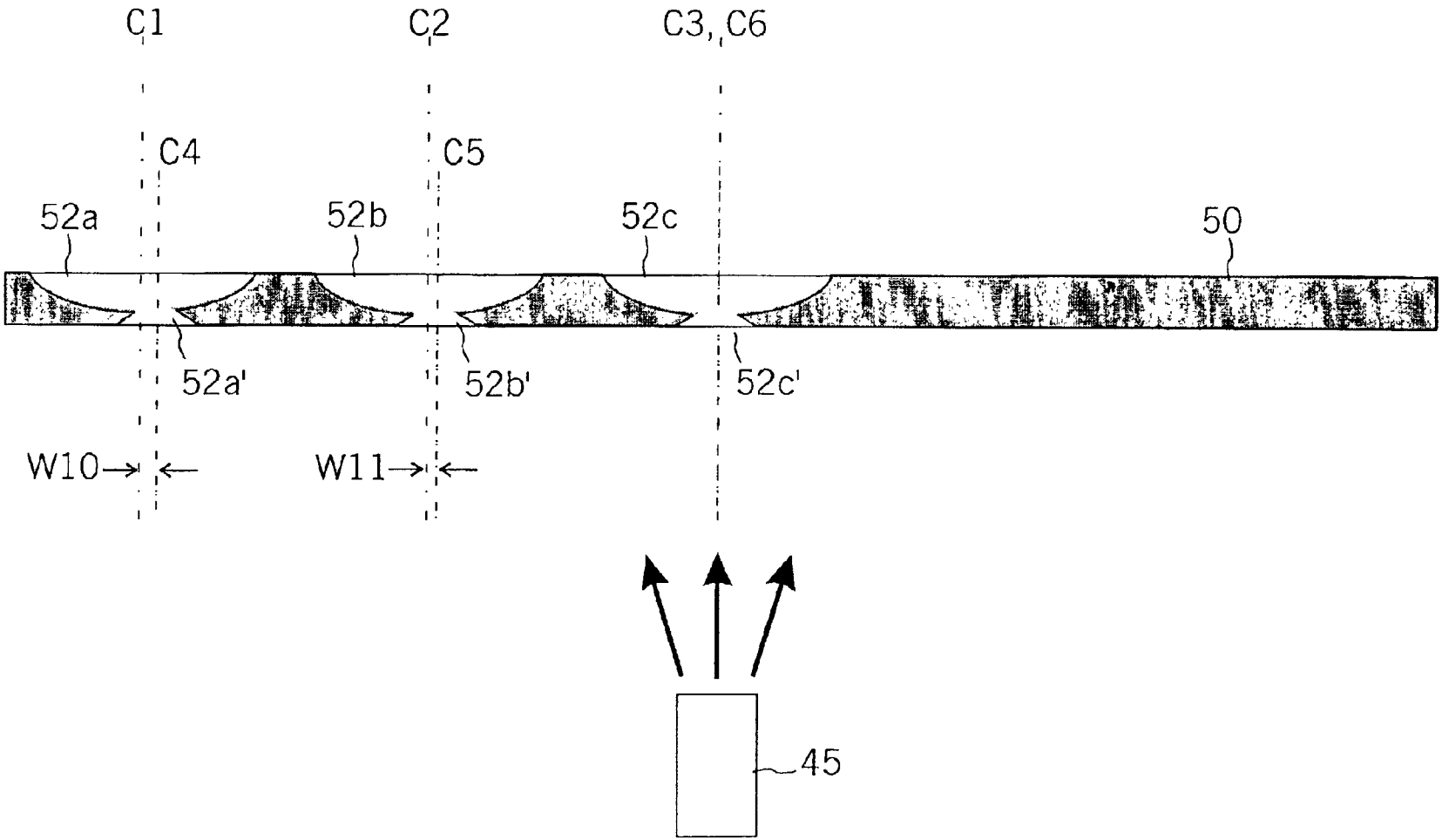
FIG. 17 shows a view of a shadow mask, in accordance with the principles of the present invention.

The horizontal center of the slot upon which electron beams are incident is off-centered inward on the basis of the horizontal center of the slot from which electron beams come out, in the direction from the center of the mask to the periphery thereof, as shown in FIG. 17. FIG. 17 shows a shadow mask 50, in accordance with the principles of the present invention. An electron gun 45 emits an electron beam toward the mask 50. Three orifices are shown penetrating through the mask 50. Each of the three orifices is comprised of an upper slot and a lower slot. The upper slots 52*a*, 52*b*, and 52*c* are located at the upper surface of the mask 50, as shown in FIG. 17. The lower slots 52*a*', 52*b*', and 52*c*' are located at the lower surface of the mask 50, closer to the electron gun 45, as shown in FIG. 17. The upper slot 52*c* and the lower slot 52*c*' are both located near a central region of the mask 50. The upper slot 52*a* and the lower slot 52*a*' are both located near a periphery region of the mask 50, which is away from the central region of the mask 50. The upper slot 52*b* is located between the upper slots 52*a* and 52*c*.

In FIG. 17, the horizontal center of upper slot 52*a* is shown by vertical center line C1. The horizontal center of upper slot 52*b* is shown by vertical center line C2. The horizontal center of upper slot 52*c* is shown by vertical center line C3. The horizontal center of lower slot 52*a*' is shown by vertical center line C4. The horizontal center of lower slot 52*b*' is shown by vertical center line C5. The horizontal center of lower slot 52*c*' is shown by vertical center line C6.

FIG. 17 shows that the center C6 of the lower slot 52*c*' is aligned with the center C3 of the upper slot 52*c*. The center C5 of the lower slot 52*b*' is separated from the center C2 of the upper slot 52*b* by a width W11. The center C4 of the lower slot 52*a*' is separated from the center C1 of the upper slot 52*a* by a width W10. The width W10 is greater than the width W11.

The center C4 is closer to the central region of the mask 50 than is the center C1. The center C5 is closer to the central region of the mask 50 than is the center C2.

As shown in FIG. 17. the structure of the slots in the mask 50 and the relationship among the upper slots and the lower slots allow more of the electron beam to successfully pass through the mask 50 than other structures. As shown in FIG, 17, the structure of the slots in the mask 50 and the relationship among the upper slots and the lower slots block less of the electron beam emitted from the electron gun 45 than other structures.

The electron beam from electron gun 45 will be incident on the shadow mask 50 at the periphery of the mask 50 at a different angle than at the central region of the mask 50. The angle formed between the incident electron beam and the lower surface of mask 50 is smaller at the periphery of the mask 50 than the angle formed at the central region of mask 50. A favorable amount of the electron beam will be able to pass through lower slot 52*a*' and upper slot 52*a* because the lower slot 52*a*' is moved slightly more toward the central region of mask 50.

At the central region of mask 50, the center of the upper slot and the center of the lower slot are aligned because the electron beam travels straight toward the mask 50 and the angle can be about 90 degrees. FIG. 8 shows the electron beam going straight toward the mask 50 with an angle of about 90 degrees formed between the incident electron beam and the lower surface of the mask 50.

Figure 18:
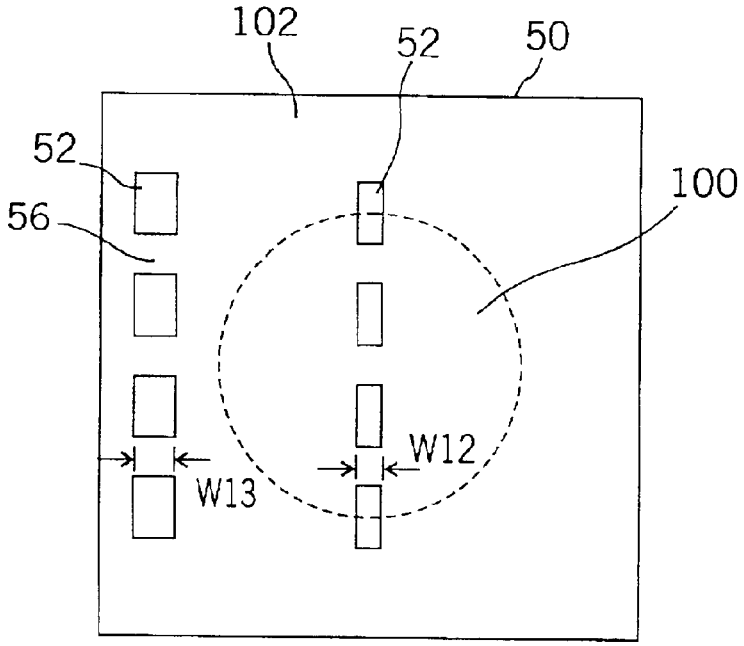
FIG. 18 shows a view of a shadow mask, in accordance with the principles of the present invention.

The width of the bridge 56 perpendicular to the length direction of a slot is wider in the direction from the center of the mask to the periphery thereof, as shown in FIG. 18. In other words, the width W12 of a bridge 56 at a central region 100 of the mask 50 is smaller than the width W13 of a bridge 56 at a periphery region 102 of the mask 50. The bridges 56 are formed so that the widths of the bridges gradually increase when one looks at the center of the mask and then looks across the mask over to the periphery of the mask.

Figure 9:
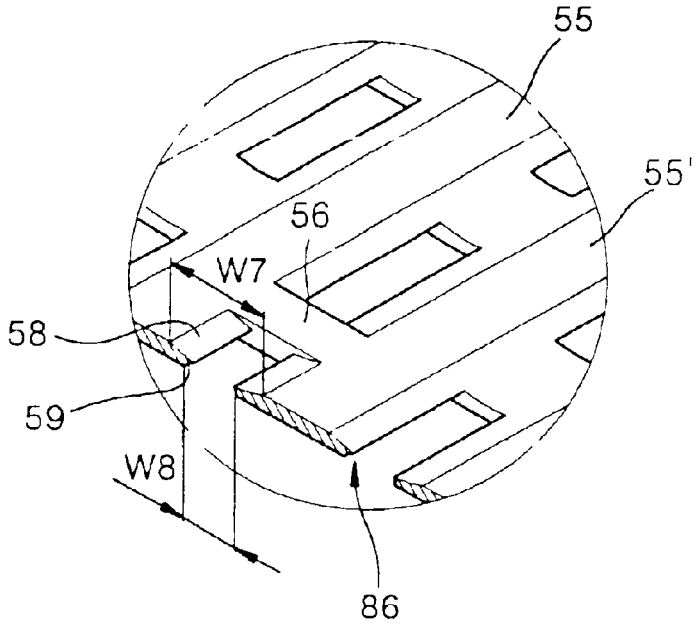
FIG. 9 is a perspective view of a mask, in accordance with the principles of the present invention, according to a second embodiment.

FIG. 9 is a perspective view of a mask according to another embodiment of the present invention. In this embodiment, the same reference numerals as those of the previous embodiment denote the same members.

As shown in FIG. 9, the bridge 56 between the strips 55 and 55' has a first curved portion 58 formed on the side from which electron beams come out, and a second curved portion 59 formed on the side upon which electron beams are incident. The first curved portion 58 has a width W7 in the direction perpendicular to the length direction of the strips 55 and 55', and extends in the length direction of the strips 55 and 55'. The second curved portion 59 has a width W8 that is smaller than the width W7 in the direction perpendicular to the length direction of the adjacent strips 55 and 55'.

Here, since the bridge 56 has the first curved portion 58 having the width W7 at the side from which electron beams go out, it indicates that an indent as described above is formed on the bridge. However, the present invention is not limited to this embodiment. That is, the upper surface of a bridge may not have an indent. In this case, the width of a bridge on which an indent is formed, in the length direction of a slot, can be equal to the width of a bridge on which no indents are formed, in the length direction of a slot. The bridge having no indents on its upper surface can have a narrow width in the direction of strips. The width of the bridges in the length direction of slots is narrower in the direction from the center of the mask to the periphery thereof.

In the mask, the width W6 of the surface of the slot from which electron beams come out is greater than the width W5 of the surface of the slot upon which electron beams are incident, and the center of the width W5 through which electron beams are incident is biased toward the electron beams on the center with respect to the center of the width W6. The indent 56*a* (FIG. 7) is formed on the upper surface of the bridge 56, so that the amount of electron beams clipped while passing through the slot can be reduced. To be more specific, electron beams emitted from the electron gun 45 (FIG. 4) of the cathode ray tube are deflected by the deflection yoke 47, pass through the slots formed on the holey portion 51 (FIG. 6) of the mask, and land on the fluorescent film. Here, the etching boundaries of adjacent strips 55 and 55' on the mask are formed on the centers of their lateral sides, so that the aperture width between the strips 55 and 55' is maximized. The center of the inlet side of the slot is off-centered toward the center portion of the mask on the basis of the center of the outlet side of the slot, so that the amount of electron beams passing through the slot is increased to thus reduce the amount of clipping of electron beams, compared to other methods.

In particular, as shown in FIG. 7, formation of the indent 56*a* on the upper surface of the bridge 56 results in a relatively-thin thickness T1, so that the cross-sectional area of the bridge can be reduced. Thus, the amount of electron beams clipped in the direction of arrangement of slots 52 can be reduced.

Figure 19:
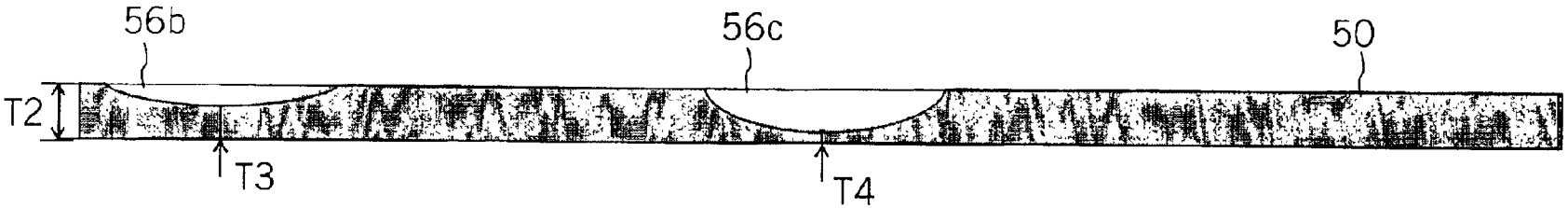
FIG. 19 shows a view of a shadow mask, in accordance with the principles of the present invention.

FIG. 19 shows that an indentation 56*c* in a bridge at a central region of mask 50 is deeper than an indentation 56*b* in a bridge at a periphery of mask 50 because thickness T3 is greater than thickness T4. The thicknesses T3 and T4 are measured from the bottom surface of mask 50 to the bottom of the respective indentations.

Figure 10:
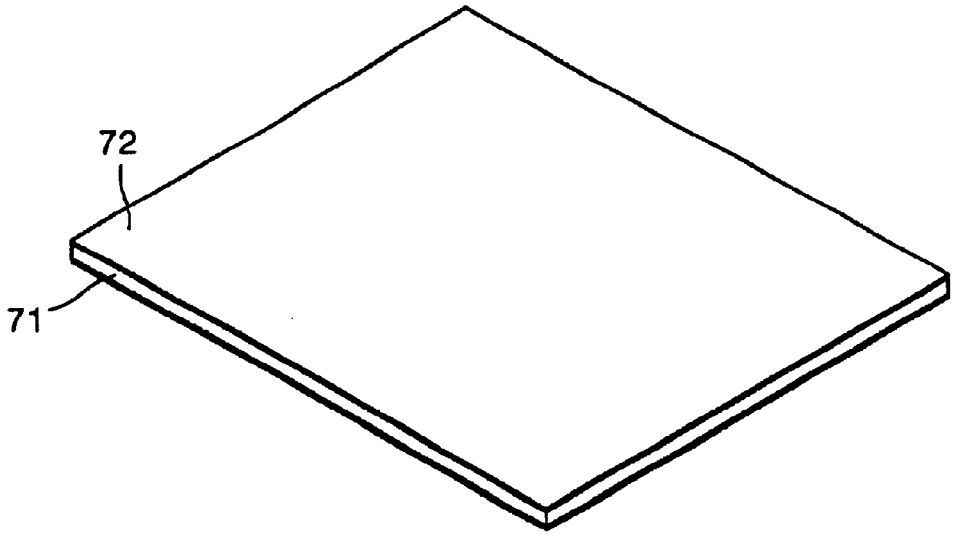
FIGS. 10, 11, and 13 through 16 are views for illustrating a method of manufacturing a tension mask, in accordance with the principles of the present invention.

A method of manufacturing a mask having such a configuration and an embodiment of upper and lower exposure masks for exposing a mask will now be described. FIGS. 10 through 16 are views for illustrating a method of manufacturing a mask according to the present invention. As shown in FIG. 10, first, a thin plate 71 for forming a mask is provided, and the upper and lower surfaces of the thin plate are covered with photosensitive films 72.

Figure 11:
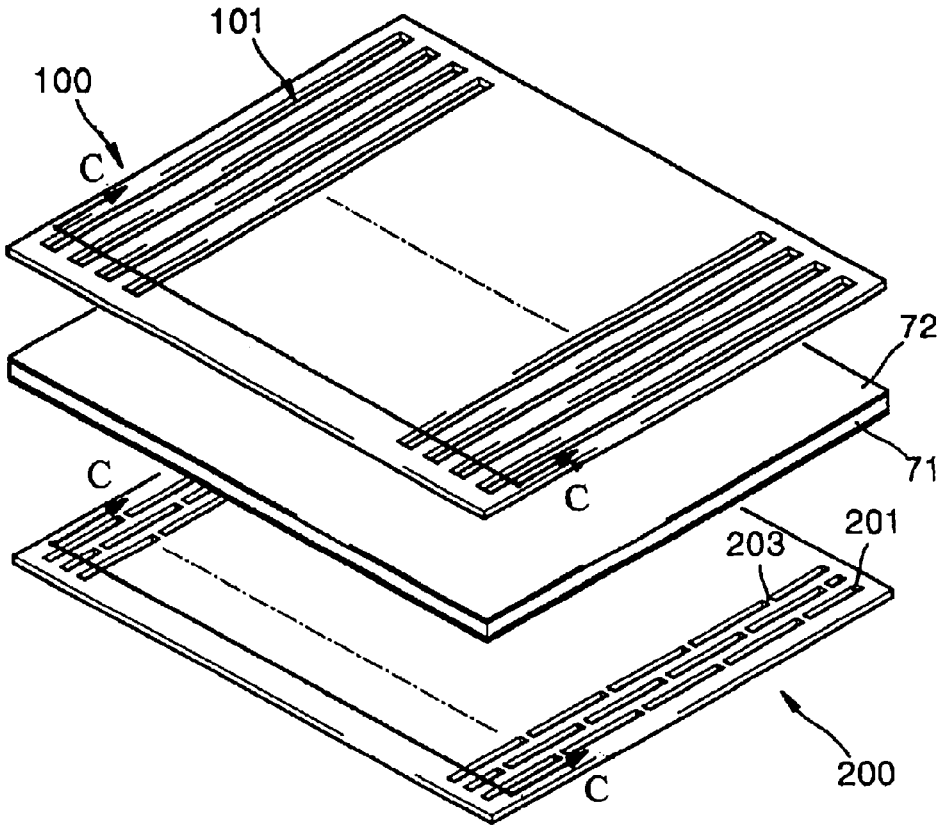

As shown in FIG. 11, when the coating of the photosensitive films 72 is completed, upper and lower exposure masks 100 and 200 are closely arranged on the upper and lower surfaces of the thin plate 71, respectively.

Here, the upper exposure mask 100 has an exposure pattern in which upper light transmission strips 101 are formed in parallel to each other. The upper light transmission strips 101 have widths large enough to form slots and first curved portions. Preferably, the width of each of the upper light transmission strips 101 is twice the width of each slot on the mask.

Figure 12:
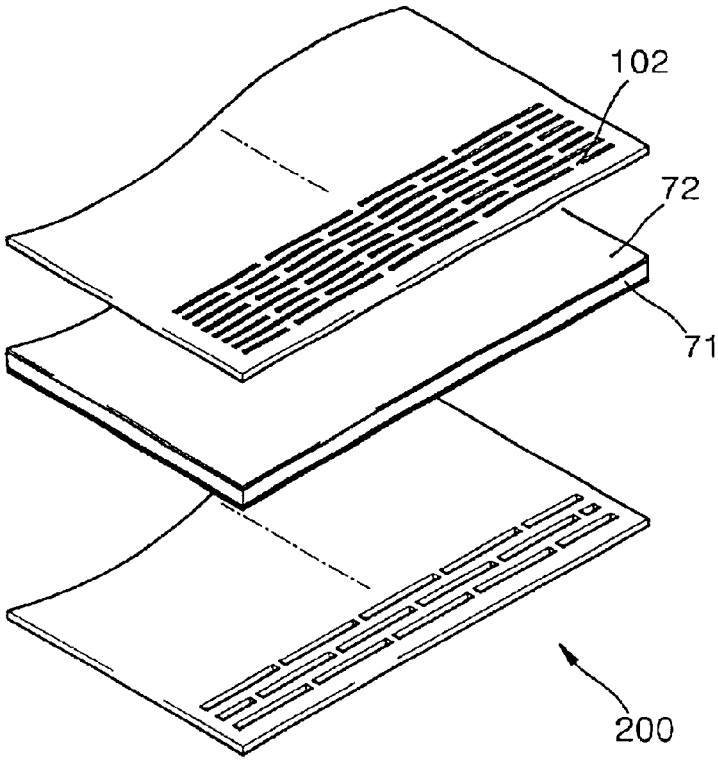
FIG. 12 is a view for illustrating a method of manufacturing a tension mask.

FIG. 12 shows upper light blocking bridges 102 which can be formed on the upper light transmission strips 101 to partition each of the upper light transmission strips 101. The features shown in FIG. 12 can be improved. The features shown in FIG. 11 constitute an improvement over the features shown in FIG. 12. FIG. 11 is an advancement over FIG. 12, since upper light blocking bridges 102 are not used in FIG. 11. The upper light blocking bridges 102 can be costly to manufacture and align.

The lower exposure mask 200 has an exposure pattern in which lower light transmission strips 201 are formed in parallel to each other, and lower light blocking bridges 203 for partitioning the lower light transmission strips 201 are formed.

Figure 13:
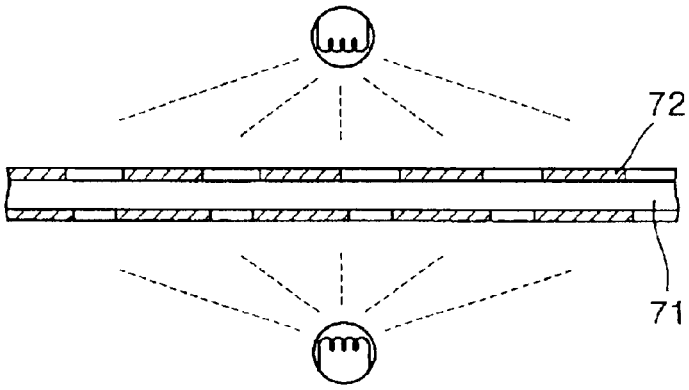

FIG. 13 is a cross-sectional view of FIG. 11 taken along line C—C after the exposure masks 100 and 200 are closely arranged on plate 71. As shown in FIG. 13, when the upper and lower exposure masks 100 and 200 having such configurations have been completely arranged on the upper and lower surface of the thin plate 71, the photosensitive films 72 coated on the upper and lower surfaces of the thin plate are exposed to light. Here, preferably, the amount of light radiated to each portion on the photosensitive films 72 is invariable.

Figure 14:
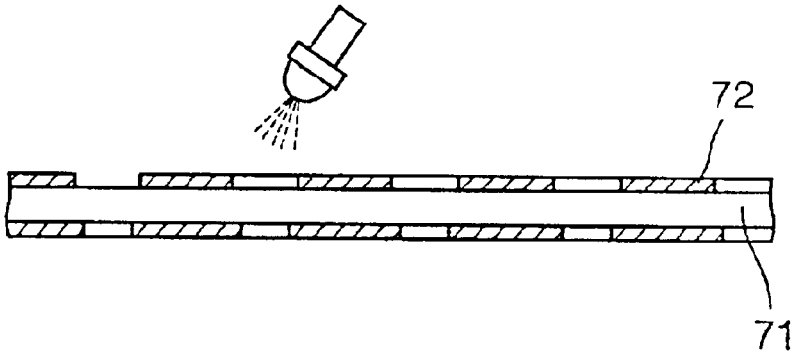
Figure 15:
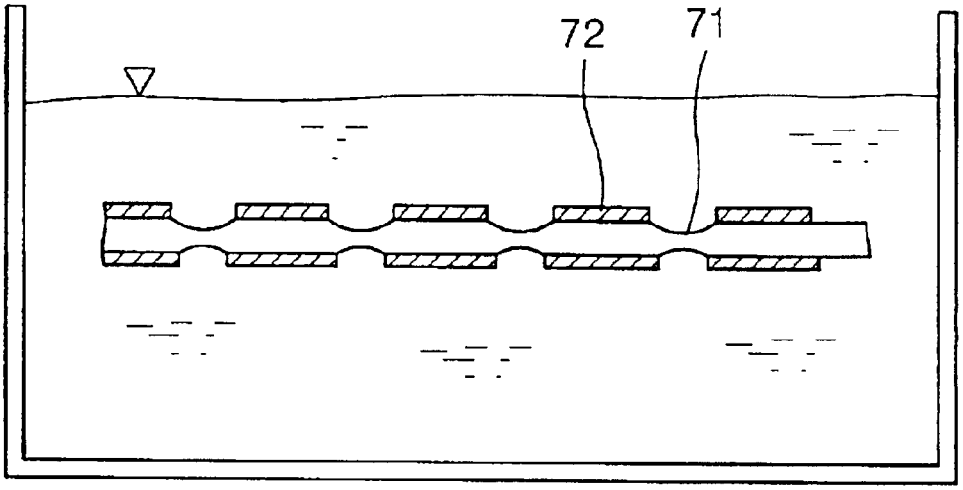
Figure 16:
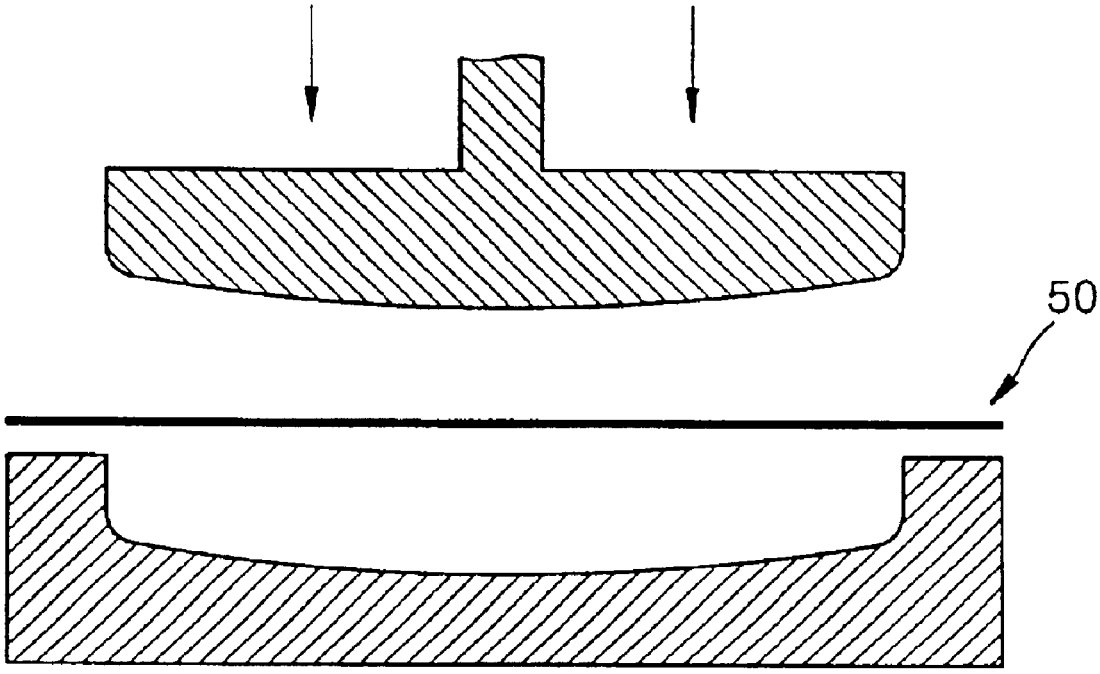

When the photosensitive films 72 on the thin plate 71 have been completely exposed, the upper and lower exposure masks 100 and 200 are separated from the thin plate 71. Thereafter, as shown in FIG. 14, the photosensitive films are developed using developing water. Then, as shown in FIG. 15, the thin plate, the photosensitive films on which have been developed, is etched using an etch solution and then developed.

After the development of the mask is completed as described above, as shown in FIG. 16, a holey portion having slots has a predetermined curvature, and a skirt portion is folded from the holey portion.

As described above, in the mask manufacturing method, there is no need to form light blocking bridges on both the upper and lower exposure masks as in other methods. Thus, the present invention has a simple exposure pattern, which is desirable. Also, since the trajectory of light for exposing the photosensitive films is the same as that of electron beams, light passing through the slots is prevented from being clipped, thereby preventing the slots in the peripheral portion of a mask from becoming smaller.

In a mask for color cathode ray tubes according to the present invention having such a configuration, a manufacturing method thereof, and exposure masks for manufacturing the mask, highly-minute slot and bridge patterns are obtained. In other words, extremely small slot and bridge patterns are obtained by using the present invention. These extremely small slot and bridge patterns are highly desirable.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicants' general inventive concept.

What is claimed is:

1. A mask for a color cathode ray tube, the mask comprising:

a plurality of strips being parallel to each other, being distinguishable from each other, and being located at predetermined intervals; and a plurality of bridges connecting adjacent ones of said strips to each other and forming slots extending from a first surface of said mask to a second surface of said mask, said slots being penetrated by electron beams, said bridges being indented to a predetermined depth from said first surface of said mask so that a thickness of said mask at a central portion of said bridges is relatively thinner than a thickness of said mask at an outer portion of said bridges;

said plurality of bridges including first bridges near a central region of said mask and including second bridges near a periphery region of said mask away from said central region, a first width of said first bridges as measured perpendicular to a length direction of said slots being smaller than a second width of said second bridges, said first and second widths being measured perpendicular to the length direction of said slots.

2. The mask of claim 1, said slots formed by said bridges including a first slot, the electron beams entering said first slot at said second surface of said mask and exiting said first slot at said first surface of said mask, said first slot at said second surface having a first center as measured substantially parallel to said first surface of said mask, said first slot at said first surface having a second center as measured substantially parallel to said first surface of said mask, said first and second centers of said first slot not being aligned with each other.

3. The mask of claim 2, said mask having a central region and a periphery region away from said central region, said first slot being located in said periphery region at a first position not close to said central region, said first center being closer to said central region than said second center, said first center being separated from said second center by a first length as measured substantially parallel to said first surface of said mask.

4. The mask of claim 3, said slots formed by said bridges further including a second slot, the electron beams entering said second slot at said second surface of said mask and exiting said second slot at said first surface of said mask, said second slot at said second surface having a first center as measured substantially parallel to said first surface of said mask, said second slot at said first surface having a second center as measured substantially parallel to said first surface of said mask, said first and second centers of said second slot not being aligned with each other.

5. The mask of claim 4, said second slot being located in said periphery region at a position close to said central region, said first center of said second slot being closer to said central region than said second center of said second slot, said first center of said second slot being separated from said second center of said second slot by a second length as measured substantially parallel to said first surface of said mask, said second length being less than said first length.

6. A mask for a color cathode ray tube, the mask comprising:

a plurality of strips being parallel to each other, being distinguishable from each other, and being located at predetermined intervals; and a plurality of bridges connecting adjacent ones of said strips to each other and forming slots extending from a first surface of said mask to a second surface of said mask, said slots being penetrated by electron beams, said bridges being indented to a predetermined depth from said first surface of said mask so that a thickness of said mask at a central portion of said bridges is relatively thinner than a thickness of said mask at an outer portion of said bridges;

said plurality of bridges forming said slots in a slotted region of said mask, said slots not being formed in a non-slotted region of said mask, said plurality of bridges including first bridges near a center of said slotted region of said mask and including second bridges near a periphery of said slotted region away from said center, said first bridges being indented to a first predetermined depth, said second bridges being indented to a second predetermined depth, said first predetermined depth being deeper than said second predetermined depth.

7. The mask of claim 1, said plurality of bridges including first bridges near a central region of said mask and including second bridges near a periphery region of said mask away from said central region, a vertical length of said first bridges as measured substantially parallel to a length direction of said slots being smaller than a vertical length of said second bridges as measured substantially parallel to the length direction of said slots.

8. The mask of claim 1, each one of said slots formed by said plurality of bridges having a first curved portion adjacent to an upper surface of said mask and having a second curved portion adjacent to a lower surface said mask, said first curved portion extending in the length direction of said strips and having a first width as measured substantially perpendicular to a length direction of said strips, said second curved portion extending in the length direction of said strips and having a second width as measured substantially perpendicular to the length direction of said strips, said first width being larger than said second width.

9. The mask of claim 8, said slots formed by said bridges including a first slot, the electron beams entering said first slot at said second surface of said mask and exiting said first slot at said first surface of said mask, said first slot at said second surface having a first center as measured substantially parallel to said first surface of said mask, said first slot at said first surface having a second center as measured substantially parallel to said first surface of said mask, said first and second centers of said first slot not being aligned with each other.

10. The mask of claim 9, said mask having a central region and a periphery region away from said central region, said first slot being located in said periphery region at a first position not close to said central region, said first center being closer to said central region than said second center, said first center being separated from said second center by a first length as measured substantially parallel to said first surface of said mask.

11. The mask of claim 10, said slots formed by said bridges further including a second slot, the electron beams entering said second slot at said second surface of said mask and exiting said second slot at said first surface of said mask, said second slot at said second surface having a first center as measured substantially parallel to said first surface of said mask, said second slot at said first surface having a second center as measured substantially parallel to said first surface of said mask, said first and second centers of said second slot not being aligned with each other.

12. The mask of claim 11, said second slot being located in said periphery region at a position close to said central region, said first center of said second slot being closer to said central region than said second center of said second slot, said first center of said second slot being separated from said second center of said second slot by a second length as measured substantially parallel to said first surface of said mask, said second length being less than said first length.

13. The mask of claim 1, said plurality of strips corresponding to light blocking strips, said first surface of said mask corresponding to an upper surface of said mask, said second surface of said mask corresponding to a lower surface of said mask, said mask being manufactured by coating upper and lower surfaces of said mask with photosensitive films, arranging an upper exposure device on said upper surface of said mask, said upper exposure device having an exposure pattern with upper light transmission strips being formed in parallel to each other, arranging a lower exposure device on said lower surface of said mask, said lower exposure device having an exposure pattern with lower light transmission strips being formed in parallel to each other and having lower light blocking bridges separating said lower light transmission strips, exposing said photosensitive films to light in a state where said upper and lower exposure devices are arranged on said mask, separating said upper and lower exposure devices from said mask, developing said photosensitive films on said mask, etching said mask when said developing of said photosensitive films is performed, and molding said mask to have a predetermined curvature.

14. The mask of claim 1, said plurality of strips corresponding to light blocking strips, said first surface of said mask corresponding to an upper surface of said mask, said second surface of said mask corresponding to a lower surface of said mask, said mask being formed by an exposure mask assembly, said exposure mask assembly comprising:

an upper exposure device being closely attached to said upper surface of said mask, said upper surface being coated with photosensitive films, said upper exposure device having an exposure pattern with upper light transmission strips being formed in parallel to each other; and a lower exposure device being closely attached to said lower surface of said mask, said lower surface being coated with photosensitive films, said lower exposure device having an exposure pattern with lower light transmission strips being formed in parallel to each other and having lower light blocking bridges separating said lower light transmission strips, said lower light blocking bridges blocking light;

said photosensitive films on said upper and lower surfaces being exposed to light penetrating said upper and lower exposure devices through said upper and lower light transmission strips, respectively.

* * * * *